United States Patent [19]

Steinbach

[11] 4,395,893

[45] Aug. 2, 1983

[54] PLATE TUMBLER-TYPE CYLINDER LOCK MECHANISM

[75] Inventor: Robert L. Steinbach, Glendale Heights, Ill.

[73] Assignee: Chicago Lock Co., Chicago, Ill.

[21] Appl. No.: 289,271

[22] Filed: Aug. 3, 1981

[51] Int. Cl.[3] ..... E05B 9/04; E05B 29/04

[52] U.S. Cl. ..... 70/364 R; 70/373

[58] Field of Search ..... 70/362, 363, 364 R, 70/364 A, 372, 373, 374, 375, 421

[56] References Cited

U.S. PATENT DOCUMENTS

| | | | |
|---|---|---|---|
| 2,282,698 | 5/1942 | Biemer | 70/364 R |
| 3,418,833 | 12/1968 | Kerr | 70/421 |
| 3,705,508 | 12/1972 | Fritsch | 70/373 |

FOREIGN PATENT DOCUMENTS

| | | | |
|---|---|---|---|
| 2383293 | 10/1978 | France | 70/373 |

*Primary Examiner*—Robert L. Wolfe

*Attorney, Agent, or Firm*—Gerlach, O'Brien & Kleinke

[57] ABSTRACT

An improvement in a plate tumbler-type cylinder lock mechanism including an elongate barrel having a longitudinal bore therein, and a key plug having a body portion and a shaft portion extending therefrom, such plug being received rotatably in the bore with the body portion extending between opposite ends of the barrel and the shaft portion extending outwardly from one end of the barrel, the bore having a draft-induced longitudinal taper widening in the direction of the said one end of the barrel, such improvement including journal means on the body portion and projecting laterally therefrom for journalling the plug in the barrel adjacent to the said one end thereof, thereby to minimize lateral play between the plug and the barrel thereat. Preferred structure for limiting the rotation of the plug embodies stop means for interengaging the journal means and the barrel.

12 Claims, 17 Drawing Figures

PLATE TUMBLER-TYPE CYLINDER LOCK MECHANISM

TECHNICAL FIELD

This invention relates in general to key-operated cylinder locks, and, more particularly, to a plate tumbler-type cylinder lock mechanism having a lessened tendency to malfunction.

BACKGROUND OF THE INVENTION

In use, certain cylinder lock mechanisms of the plate-tumbler type exhibit, at times, problems of difficult key insertion and removal, key plug binding with consequent difficulty in rotating the plug in the barrel, or interference with proper performance of the locking function. These problems arise from the skewing of the key plug in the barrel, caused by radial forces exerted on an end of the plug by, for example, lock accessories attached thereto. The skewing may force the plate tumblers and/or the plug body into frictional contact with internal surfaces of the barrel, or move the tumblers out of alignment with their grooves, to prevent locking.

Skewing is made possible by lateral play or looseness of the plug in the barrel at one end thereof. In lock barrels made by the die casting process, the play is caused by the need to provide a "draft" in bores or internal cavities, for core-pulling purposes. Thus, a draft-induced taper is produced in a barrel bore, whereby the diameter of the bore is greater at one of its ends than at the other. Inasmuch as the plug body is generally cylindrical, it is loose in the bore where the diameter is greater.

The problems caused by play of the plug are more pronounced where the end use necessitates an elongate lock mechanism the elongate barrel of which varies substantially in bore diameter from one end to the other. Manufacturing options available for minimizing the problems are limited, especially where a shoulder must be provided at one end of an elongate barrel. Such a shoulder is provided in the lock mechanism of U.S. Pat. No. 3,418,833, for example.

SUMMARY OF THE INVENTION

The present invention provides a new and improved plate tumbler-type cylinder lock mechanism, particularly a mechanism including an elongate barrel, which has a lessened tendency to malfunction, in particular, due to skewing. More particularly, the invention such a lock mechanism which minimizes or avoids interference with key insertion, such as caused by misalignment of plate tumblers, and interference with rotation of the plug caused by frictional engagement of the plug with the barrel. The invention also serves to insure that there is no interference with proper performance of the locking function, and the basic operation of the lock mechanism remains the same.

The improved lock mechanism may be produced at material, labor, and equipment costs comparable to the conventional mechanism, and employing the same number of parts.

The invention provides an improvement in a plate tumbler-type cylinder lock mechanism including an elongate barrel having a longitudinal bore therein, and a key plug having a body portion and a shaft portion extending therefrom, such plug being received rotatably in the bore with the body portion extending between opposite ends of the barrel and the shaft portion extending outwardly from one end of the barrel, the bore having a draft-induced longitudinal taper widening in the direction of the said one end of the barrel, such improvement comprising journal on the body portion and projecting laterally therefrom for journalling the plug in the barrel adjacent to the said one end thereof, thereby to minimize lateral play between the plug and the barrel thereat. In a preferred embodiment, stop means are provided for interengaging the journal means and the barrel, thereby to limit the rotation of the plug.

In a further preferred embodiment, the improvement of the invention is provided in an elongate lock mechanism having a transverse shoulder on the wall of the bore adjacent to the end of the barrel opposite to the said one end thereof, and wherein the taper extends from adjacent to such shoulder to adjacent to the said one end. In such structure, the shoulder of which is represented by the structure of the above-identified patent, the taper is relatively lengthy and the plug play is pronounced, so that the invention as applied thereto is especially advantageous. The improved structure is adapted for mounting in the barrel of the lock mechanism from its rear end, rather than from the front end in the conventional manner, to provide assembly and cost advantages.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
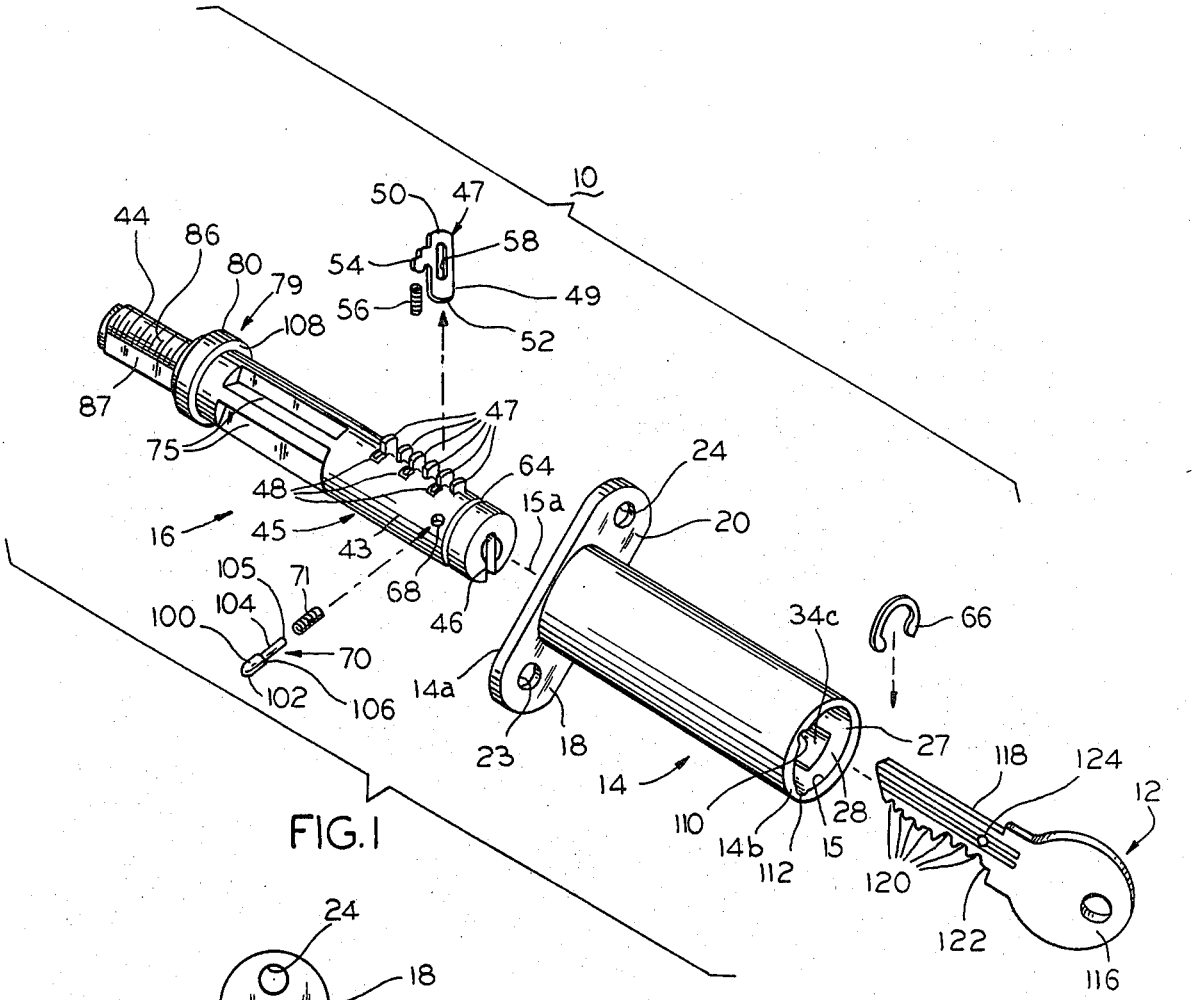
FIG. 1 is an exploded perspective view of a lock mechanism embodying the improvement of the invention, together with its key.
Figure 2:
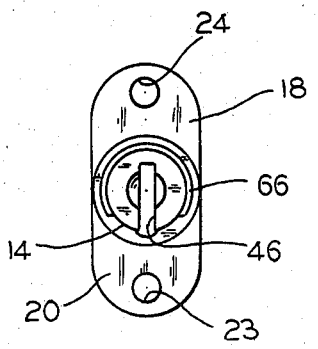
FIG. 2 is a front end elevational view of the lock mechanism.
Figure 3:
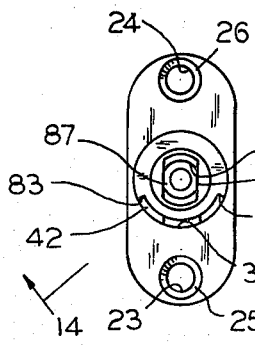
FIG. 3 is a rear end elevational view of the lock mechanism.

Referring to the drawings, and in particular to FIGS. 1–6, a tamperproof cylinder lock mechanism 10 of the plate tumbler type is shown, which constitutes a preferred embodiment of the present invention. A single-bitted key for the lock is designated 12.

The lock mechanism 10 and the key 12 are similar to the tamperproof cylinder lock and key disclosed in U.S. Pat. No. 3,418,833, with modifications and improvements in the lock mechanism, as described hereinafter. The lock mechanism includes an elongate or lengthy, generally cylindrical tubular barrel 14 and a key plug assembly 16. The barrel 14 has a longitudinal bore 15 having a longitudinal axis 15A. The key plug assembly 16 is mountable in the barrel 14 for rotation about the axis 15A and cooperates with the barrel in a conventional manner, to provide locking and unlocking functions.

The lock barrel 14 preferably is made in the form of a one-piece casting, by the die-casting process. On a rear end 14*a* of the barrel 14, and cast integrally therewith, are oppositely extending mounting ears 18 and 20 having respective fastener openings 23 and 24, and counterbores 25 and 26 therein. The lock mechanism 10 is mounted for use by suitable fasteners, such as bolts or screws (not shown), having their heads seated in the counterbores 25 and 26, and extending through the openings 23 and 24 into, for example, a door or a drawer panel or the like (not shown), through which the barrel 14 extends.

Figure 4:
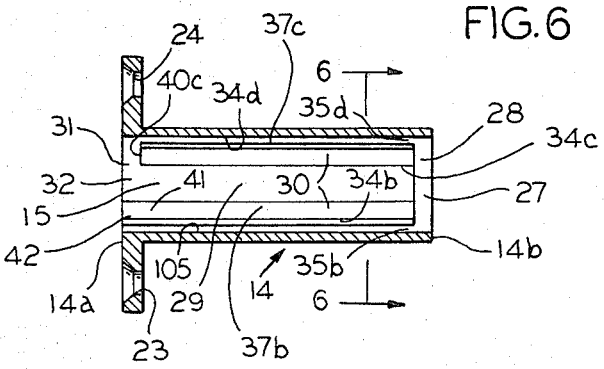
FIG. 4 is a longitudinal axial sectional view of a barrel of the lock mechanism, taken substantially on line 4—4 of FIG. 5.

Referring to FIG. 4, the barrel 14 includes three integral longitudinal sections. A front section 27, having an inner annular bearing surface 28, extends rearwardly from the front end 14*b* of the barrel 14. An intermediate section 29, having an inner surface 30 which is a continuation of the foregoing bearing surface 28, extends rearwardly therefrom to a rear section 31 proximate to the rear end 14*a* of the barrel 14. The rear section 31 has an inner arcuate bearing surface 32 of enlarged diameter. The bearing surface 28 of the front section 27 and the inner surface 30 of the intermediate section 29 correspond to or define the bore proper 15 of the barrel.

Figure 6:
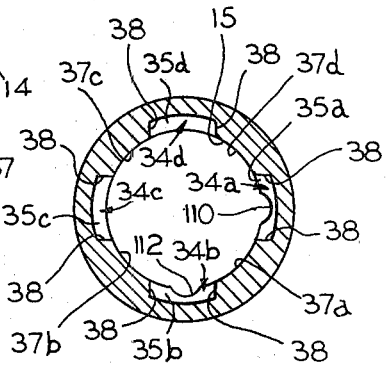
FIG. 6 is a cross-sectional view of the barrel, taken substantially on line 6—6 of FIG. 4.

Referring also to FIG. 6, four equiangularly spaced splines or grooves 34*a*, 34*b*, 34*c* and 34*d* are formed in the intermediate section 29 and extend longitudinally and rearwardly therein from the front section 27 to the rear section 31. Radially inwardly extending shoulders 35*a*, 35*b*, 35*c* and 35*d* are formed at the junctions of the respective splines 34*a*, 34*b*, 34*c* and 34*d* with the front section 27. The bottom surfaces of the splines 34*a*, 34*b*, 34*c* and 34*d* are continuous with the bearing surface 32 of the rear section 31.

The provision of the splines 34*a*, 34*b*, 34*c* and 34*d* leaves four equiangularly spaced ribs or lands 37*a*, 37*b*, 37*c* and 37*d* remaining on the inside of the barrel 14 integrally therewith. The inner surfaces of the ribs are arcuate, constitute parts of the inner surface 30 of the intermediate section, and define portions of the bore 15. The ribs 37*a–d* have longitudinally extending and transversely convergent opposite side edges 38. The side edges 38 on respective ribs 37*a–d* are parallel to the side edges of adjacent ribs, for reasons which will appear.

Figure 5:
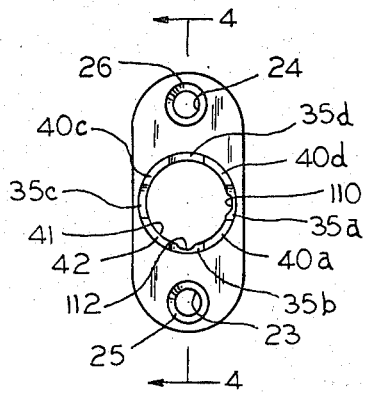
FIG. 5 is a rear end elevational view of the barrel.

As seen in FIGS. 4 and 5, the rear ends of three of the ribs, which ribs are numbered 37*a*, 37*c* and 37*d*, form radially inwardly extending plug-seating shoulders 40*a*, 40*c* and 40*d*, respectively, which extend radially inwardly from the bearing surface 32 of the rear section 31. A plug-stop lug 42 (FIGS. 3–5) is integral with the barrel 14 and with the fourth rib 37*b*. The lug 42 extends rearwardly from the rear end of the fourth rib 37*b* to the rear end 14*a* of the cylinder 14. The lug 42 is a continuation of the fourth rib 37*b*, and has an arcuate inner surface 41 registering with the intermediate section inner surface 30.

As produced by casting, the bore 15 of the lock barrel 14, corresponding to the inner surfaces 28 and 30 of the front section 27 and the intermediate section 29, respectively, has a draft-induced longitudinal taper which widens in the direction of the rear end 14*a* of the barrel 14. Thus, the diameter of the bore 15 is greater adjacent to the rear end 14*a* of the barrel than adjacent to the front end 14*b* thereof. Draft is required for core-pulling purposes in the manufacturing process.

The differences in the diameters of the bore become substantial when an elongate barrel is required, and the bore is formed completely or in large part by a single core, as in the illustrative embodiment. The manufacturing options are limited in such embodiment by the requirement for forming the shoulders 35*a–d* at the ends of the splines 34*a–d*. In order to form the barrel 14 with such an internal configuration, a core must be pulled from the rear end 14*a*, which necessitates the use of a lengthy core, having the proper rearwardly divergent taper.

As regards the remaining inner surfaces of the barrel 14, the bottom surfaces of the splines 34*a–d* and the adjoining bearing surface 32 of the rear section 31 are tapered similarly to the bore 15. If desired, however, the bearing surface 32 may be substantially cylindrical, in view of its limited extent.

Referring to FIG. 1, the plug assembly 16 includes a key plug 45 having a generally cylindrical body portion 43 and a generally cylindrical integral shaft portion 44 of reduced diameter extending axially therefrom. A longitudinal series of spaced apart parallel plate tumblers 47 is mounted in transverse tumbler slots 48 in the plug, in a conventional manner, and the tumblers extend transversely across the central portion of the keyway 46.

Referring to FIGS. 1 and 11–13, each tumbler 47 includes a flat elongate body 49 having outer and inner ends 50 and 52, respectively, and a shoulder 54 extending laterally from the body 49. A coil compression spring 56 is seated on the plug in each tumbler slot 48, and the shoulder 54 of the tumbler 47 in the slot is seated on the spring, for biasing the tumbler outwardly. The tumbler body 49 is provided with a rectangular key-receiving opening 58, the disposition of which is varied among tumblers for key coding purposes, in known manner. The tumblers are freely and slidably movable in the tumbler slots 48, transversely of the plug 45.

Figure 7:
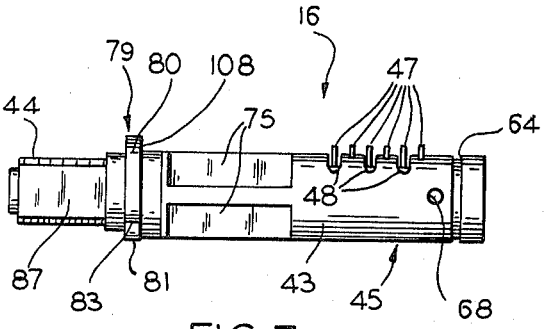
FIG. 7 is a side elevational view of a key plug of the lock mechanism.

Referring to FIGS. 1 and 7, the plug body portion 43 is provided with a peripheral annular retainer-mounting groove 64 adjacent to the front end thereof. A C-shaped retaining ring or C-ring 66 is received in the groove 64, for interengagement with the plug 45.

Referring to FIGS. 1, 7 and 15–17, a radial outer tumbler bore 68 is provided in the body portion 43, disposed in closely spaced relation to and rearwardly of the retainer-mounting groove 64. A smaller diameter radial inner tumbler bore 67 is coaxial with the outer bore 68 and extends inwardly therefrom into the keyway 46. A shoulder 69 is formed at the junction of the inner end outer bores 67 and 68. A pin-type auxiliary tumbler 70 and a tumbler-biasing coil compression spring 71 are mounted within the bores 67 and 68, for purposes described hereinafter.

Figure 8:
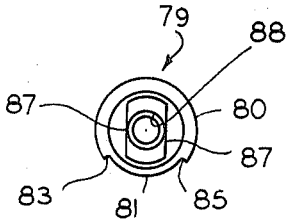
FIG. 8 is a rear end elevational view of the key plug.

Referring to FIGS. 1 and 7, the body portion 43 of the key plug 45 is formed with four recesses or reliefs 75 therearound, which extend between the rear end and the plate tumbler section of the body portion, to minimize the material required for the plug, and thus also minimize the cost and weight of the plug. As seen also in FIG. 8, journal means comprising a ring-shaped journal member or flange 79 having a narrow band-like arcuate outer bearing surface 80 is integral with the rear end of the body portion 43 and projects laterally therefrom. The journal member 79 defines an arcuate recess 81 between angularly spaced apart stop shoulders 83 and 85 thereon.

Referring to FIGS. 1 and 7–10, the shaft portion 44 is provided with a thread 86 interrupted by a pair of parallel flats 87 on opposite sides thereof. A threaded internal bore 88 extends axially within the shaft portion 44 from the rear end thereof.

As illustrated in FIGS. 1 and 15–17, the auxiliary tumbler 70 includes a generally cylindrical body 100 having a frusto-conical pointed outer end 102, and a reduced diameter stem 104 integral and coaxial with the body 100. The stem 104 has a frusto-conical pointed distal end 105, and it forms a shoulder 106 at its junction with the body 100. The length of the tumbler 70 is approximately equal to the radius of the body portion 43 of the plug 45. The auxiliary tumbler spring 71 is received in the outer bore 68 of the plug 45, where it seats on the shoulder 69 at the bottom of the bore. The stem 104 of the auxiliary tumbler 70 is inserted through the tumbler spring 71 and into the inner bore 67, while the shoulder 106 on the body 100 of the tumbler seats on the spring.

Figure 11:
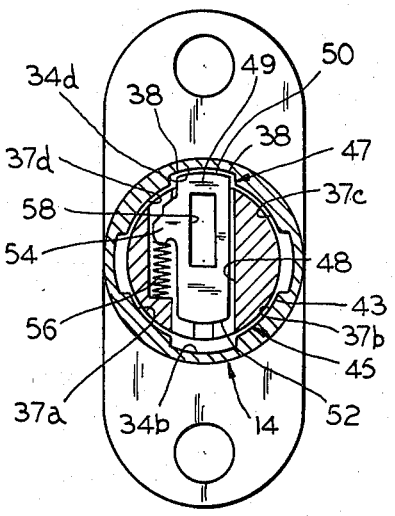
FIG. 11 is a cross-sectional view of the lock mechanism, taken substantially on line 11—11 of FIG. 9, and drawn on substantially the same scale.
Figure 12:
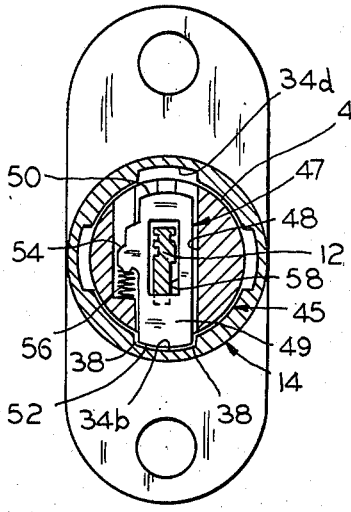
FIG. 12 is a view like FIG. 11, but showing the key partially inserted in the plug.
Figure 13:
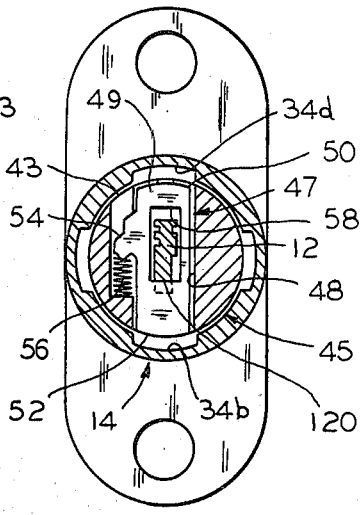
FIG. 13 is a view like FIG. 11, but showing the key fully inserted in the plug, taken substantially on line 13—13 of FIG. 10.

The lock mechanism 10 is assembled by mounting the plate tumblers 47 and their springs 56, and the auxiliary tumbler 70 and its spring 71 in the plug 45, and inserting the resulting plug assembly 16 into the barrel 14 from its rear end **14*a*, as illustrated in FIG. 1. Referring to FIGS. 11–13, a plate tumbler spring 56 is inserted in an enlarged area of each tumbler slot 48, in which it is seated, and a plate tumbler 47 is inserted in the slot, with its shoulder 54 seated on the spring. The tumbler 47 is retained in the slot by peening a portion of the plug over the shoulder 54**, in a conventional manner.

The plug assembly 16 is inserted into the barrel 14 until a forwardly facing shoulder 108 on the journal member 79 seats on the rib shoulders **40*a*, 40*c* and 40*d*, at the rear end of the plug 45, at a planar interface substantially perpendicular to the axis 15A. The stop lug 42 is received in the recess 81 provided by the journal member 79. The rear surface of the journal member 79 is substantially flush with the rear end 14*a* of the barrel 14**.

When the plug assembly 16 is inserted, the outer ends 50 of the tumblers 47 are received in either of two splines, **34*a* or 34*d*, reception in the spline numbered 34*d* being illustrated in the several views. The pointed outer end 102 of the body 100 of the auxiliary tumbler 70 is received in a first longitudinally extending arcuate notch 110 (FIGS. 1 and 15) in the bearing surface 28 of the front section 27 of the barrel when the plate tumblers 47 are received in the latter spline 34*d*. The outer end 102 of the auxiliary tumbler body 100 is received in a second such notch 112 at an angular spacing of 90° from the first notch 110, when the plate tumbler ends 50 are received in the spline numbered 34*a***.

With the plug assembly 16 fully inserted in the barrel 14 in the foregoing manner, the front end of the plug 45 projects beyond the front end **14*b* of the barrel, so that the retainer-mounting groove 64 lies closely adjacent to the front end of the barrel. The retaining ring 66 is snapped into the groove 64, where it engages the plug 45 and lies closely adjacent to the barrel front end 14*b*. Abutting engagement with the barrel end serves to closely limit longitudinal movement of the plug assembly 16 relative to the barrel 14**, while enabling the plug assembly to turn freely in the barrel.

Figure 9:
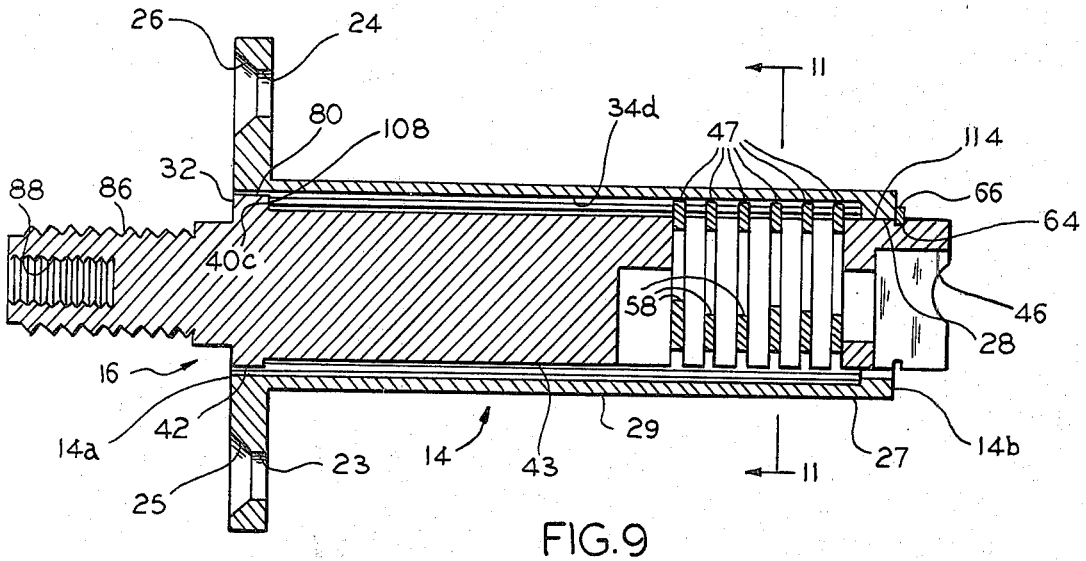
FIG. 9 is an enlarged longitudinal axial sectional view of the lock mechanism.
Figure 10:
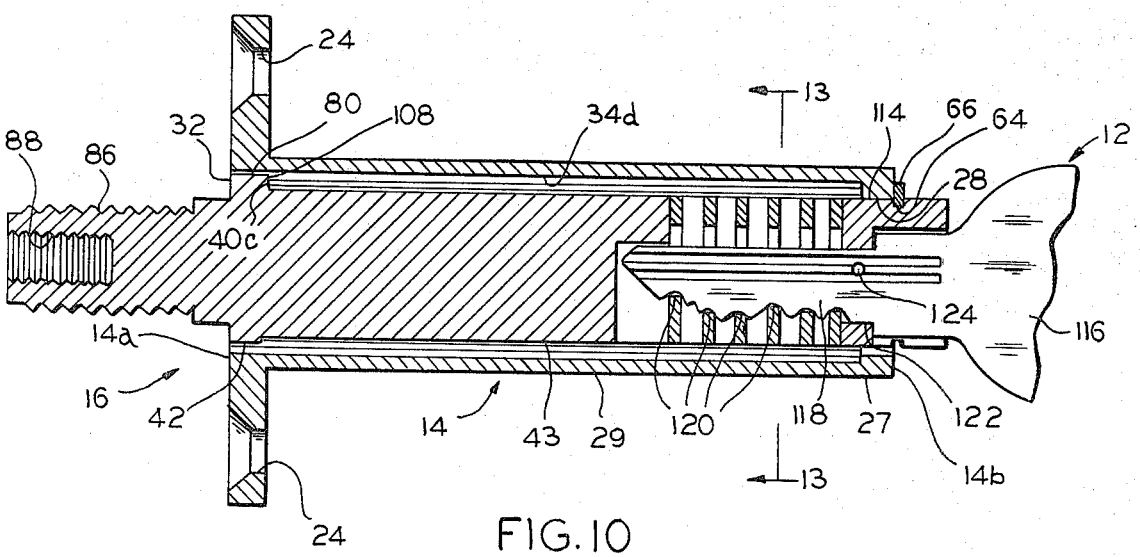
FIG. 10 is a view like FIG. 9, but showing the lock mechanism with its key fully inserted, to place the mechanism in an unlocking condition.

As illustrated in FIGS. 9 and 10, the plug 45 is journalled for rotation adjacent to the opposite ends of its body portion 43. At the front end, an annular surface area 114 on the body portion 43 and rearwardly adjacent to the retaining ring groove 64 serves as a journal, being closely received rotatably within the bearing surface 28 of the front section 27 of the barrel. At the rear end of the body portion 43, the journal member 79 on the plug 45 is closely received within the bearing surface 32 of the rear section 31 of the barrel 14, for rotation therein. The plug assembly is constrained for rotation in the barrel through an angle of 90°, by engagement of the stop shoulders 83 and 85 on the journal member 79 alternatively with the respective opposite sides of the stop plug 42.

The key 12 is a single-bitted key of generally conventional design, but incorporating the improvement of the aforesaid U.S. Pat. No. 3,418,833 for cooperation with the tamperproof lock mechanism thereof. The key 12 includes a handle 116 and an integral shank 118 having bittings 120 on one edge 122 thereof. In accordance with the aforesaid patent, a socket 124 is formed in the shank 118. When the key 12 is fully inserted in the keyway 46 of the plug 45, the socket 124 is in register or alignment with the bores 67 and 68 in the plug.

The lock mechanism 10 operates in the manner described in the aforesaid U.S. Pat. No. 3,418,833. Thus, and referring to FIGS. 9–13, the plate tumblers 47 project from their slots 48 in the plug body portion 43, and their outer ends 50 are received in the spline **34*d*. The body portion 43, and thus the plug 45, is prevented from rotating in the barrel 14 by engagement of the projecting end portions of the tumbler edges, which are parallel, with the side edges 38 of the ribs 37*c* and 37*d*, which are parallel for each spline 34*a–d***. The parallelism provides optimum locking engagement of the two.

Insertion of the key 12 into the keyway 46 results in insertion of the shank 118 through the openings 58 in successive tumblers 47. In the process, the tumblers 47 slide in and out of their slots 48, until the key is fully inserted. During insertion of the key, various ones of the tumblers 47 may at times project into the spline **34*b* opposite to the spline 34*d* into which the tumblers initially extend, the movement of the tumblers into the opposite spline 34*b* depending upon the arrangement of the bittings 120 provided on the key shank 118. When the key 12 is fully inserted, the tumblers 47 are brought into positions substantially completely within their slots 48 and within the plug body portion 43, as illustrated in FIG. 13, whereby the body portion and thus the plug 45 are enabled to rotate in the barrel 14**.

Figure 15:
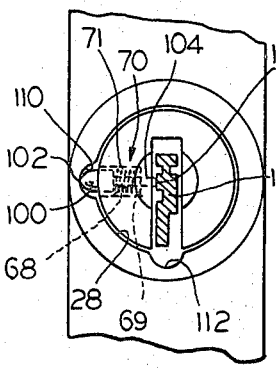
FIG. 15 is an enlarged fragmentary front elevational view of the lock mechanism, with a retaining ring thereof removed, illustrating the key, shown in section, partially inserted in the keyway of the key plug.
Figure 16:
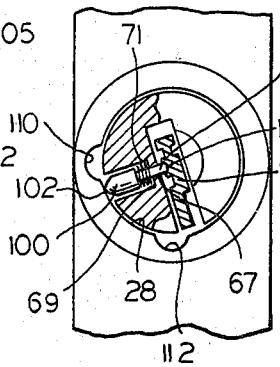
FIG. 16 is a view similar to FIG. 15, with part of the plug broken away and in section, but showing the key fully inserted and the plug rotated out of its initial position and to an intermediate position.
Figure 17:
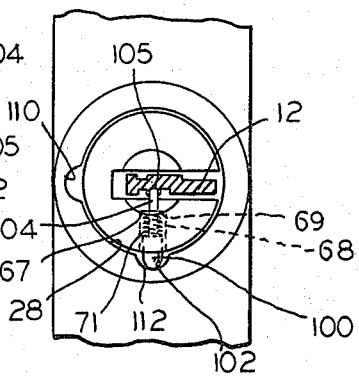
FIG. 17 is a view similar to FIG. 15, but showing the key fully inserted and the plug rotated to a final position.

FIGS. 15–17 illustrate the tamperproof features disclosed in the aforesaid U.S. Pat. No. 3,418,833. In FIG. 15, the disposition of the auxiliary tumbler 70 is illustrated as the key 12 is being inserted in the keyway 46. It will be noted that the distal end 105 of the stem 104 engages a raised surface on the key 12, whereby the tumbler 70 is prevented from moving out of the notch 110 in the barrel 14. Accordingly, the plug 45 cannot be turned in the barrel. When the key 12 is fully inserted, the socket 124 registers with the stem 104 for receiving the distal end 105 of the latter therein, as illustrated in FIG. 16. Consequently, the plug 45 may be rotated, in the counterclockwise direction in FIG. 16, to cam the body 100 of the auxiliary tumbler out of the barrel notch 110, with the socket 124 in the key accommodating the resulting radially inward movement of the auxiliary tumbler.

The foregoing structure serves to provide an additional resistance to picking, inasmuch as any key or tool which does not have a suitable recess comparable to the socket 124 but has greater thickness in the area of the tumbler 70 will maintain the interlock provided by the tumbler body 100, extending from within the plug 45 into the barrel notch 110. For the plug 45 to be rotated, therefore, it is necessary both that the plate tumblers 47 be withdrawn into the plug body 43, as illustrated in FIG. 13, and that a key socket 124 or the like be provided in register with the tumbler stem 104. It will be noted also that the auxiliary tumbler 70 serves as a key-holding element in the disposition of FIG. 16 or in any other disposition where no registering notch 110, 112, or the like is provided.

FIG. 17 illustrates completion of the rotation of the plug 45 through an angle of 90° from its initial disposition, accomplished by turning the key 12 when fully inserted in the lock mechanism. The auxiliary tumbler spring 71 biases the auxiliary tumbler 70 outwardly and into the second barrel notch 112, thereby removing the tumbler stem 104 from the key socket 124 and permitting removal of the key 12 from the lock mechanism. Were the second barrel notch 112 not provided, the key could not be removed in this disposition, resulting in a "one-way key pull" lock mechanism, rather than the illustrative "two-way key pull" mechanism.

Employing the illustrative mechanism, the plug 45 may be employed in either of the dispositions of FIGS. 15 and 17 for locking purposes, and in the remaining disposition for unlocking purposes, as desired. The lock mechanism 10 with the key 12 removed is in a locking condition or mode, with the plate tumblers 47 disposed as illustrated in FIG. 11, in either of the FIGS. 15 and 17 dispositions of the plug. With the key 12 inserted in either disposition of the plug, the lock mechanism is in an unlocking condition, with the tumblers 47 disposed as illustrated in FIG. 13.

The lock mechanism 10 is employed especially advantageously where circumstances require a relatively long span between the mounting ears 18 and 20, and the front end **14*b* of the barrel, as in the case of certain articles of office equipment, such as desks and cabinets. In such applications, locking accessories such as cams, levers, wire connections, and the like are attached to the shaft portion 44 of the plug 45. The external thread 86 and/or the internal threaded bore 88 of the shaft portion 44** may be utilized for mounting the accessories.

As often happens, sidewise tension is imparted to the shaft portion 44 through the accessories, which tension creates a tendency for the shaft portion 44 and thus the plug 45 to skew, as described above. It will be apparent upon reference to the drawings, particularly FIGS. 11–13, that such skewing may result in binding of the plug body portion 43 on the inner surfaces of the barrel 14, so as to resist turning of the plug by the key. Key operation may be impeded by frictional contact between the plate tumblers 47 and the barrel 14, in a spline **34*d* thereof, or between the tumblers 47 and the plug body portion 43, in the slots 48. The plate tumblers 47 may become misaligned with the splines 34*a–d*, so that the tumblers strike the ribs 37*a–d* as the key is being inserted or removed, to interfere with movement of the tumblers into the splines. The tumblers 47 may become misaligned with the splines 34*a–d* to the extent that the tumblers are not received in the splines in the proper manner for the locking purposes, i.e., in the manner illustrated in FIG. 11**.

Figure 14:
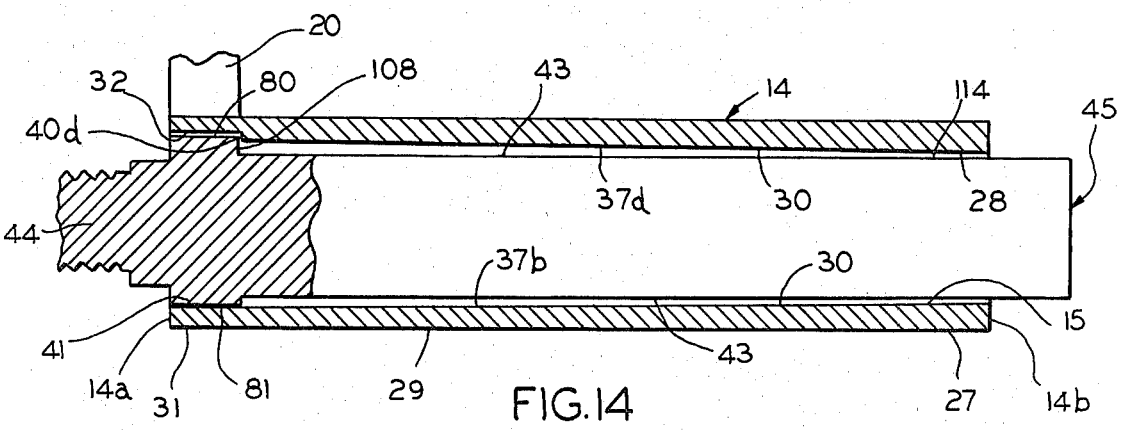
FIG. 14 is an enlarged schematic and fragmentary view of certain parts of the lock mechanism, taken substantially on line 14—14 of FIG. 3, showing diagrammatically the relationship of the outer surface of the key plug to the barrel bore.

FIG. 14 diagrammatically illustrates the barrel taper in relation to the plug body, which resulted in the prior problems due to skewing, and the manner in which the problems are overcome in the present invention. The barrel 14 is shown as a longitudinal section taken through two diametrically-opposed ribs **37*b* and 37*d*, the former of which is integral with the stop lug 42 at the rear end of the rib. The distance between the rear ends of the ribs 37*b* and 37*d* and the front end 14*b* of the barrel is approximately two inches in the illustrative embodiment, which is representative of the length required for one category of plate tumbler-type cylinder lock mechanism having a plug 45 with a nominal diameter for the plug body 43 of approximately one-half inch. Industry practice in casting the barrel 14 from zinc alloy is to provide one degree of longitudinal taper per inch in the bore 15, thereby providing the desired draft for core-pulling purposes. Such taper results in an increase in diameter of the bore 15, defined by the bearing surface 28 at the front end 14*b* of the barrel and the inner surface 30 of the intermediate section 29, of about 0.06" from the front end of the barrel to the rear ends of the ribs 37*a–d***.

Previously, a front-mounted key plug was employed with a barrel like the barrel 14, but having a recess at the front end **14*b* for engagement of the barrel with a stop lug on the plug, there being no stop means provided at the rear end 14*a*. The prior key plug had a cylindrical body and, adjacent to its front end, a stop lug on the body and an annular flange engaging the front end 14*b* of the barrel. At the rear end of the plug body, an arcuate groove was provided around the body, for reception of a split retainer ring serving to secure the plug in the barrel, by engagement with the rear ends of ribs like the ribs 37*a–d*. The prior lock mechanism constructed in this manner exhibited play or looseness, owing to the slace between the cylindrical plug body and the ribs like the ribs 37*a–d***, at the rear ends of the ribs. This play caused problems of the type described above. Also, owing to the provision of both forwardly and rearwardly facing recessed areas or shoulders, it was necessary to employ both front and rear cores in manufacturing the prior barrel.

The journal member 79 of the plug 45 of the invention projects laterally from the body portion 43 for journalling the plug in the barrel 14 adjacent to its rear end 14*a*, thereby to minimize lateral play between the plug and the barrel thereat. Thus, the journal member 79 is closely received within the rear bearing surface 32, for journalling the member in the rear section 31. The journal member 79 where recessed at 81 likewise bears on the arcuate inner surface 41 of the stop lug 42, in closely adjacent relation thereto. The entire plug assembly 16 is received in the barrel 14 and journalled therein with minimal play or looseness.

In the invention, the lug and the flange, which were adjacent to the front end of the prior key plug, are eliminated and replaced by the retaining ring 66 and its groove 64. Elimination of the lug results in the elimination of the lug-receiving recess formerly provided in the front end of the barrel. Consequently, the need for both front and rear cores and core-pulling operations in both directions is eliminated. Also, the front end 14*b* of the barrel is stronger without the recess.

The new lock mechanism 10, constructed for rear end mounting of the plug 45 in the barrel 14, enables the journal member 79 to be provided as part of a one-piece casting plug 45, as illustrated. It is to be understood, however, that while the illustrative structure is preferred, a discrete, removable journal member might be employed in place of the fixed member, particularly if it were desired to employ a front-mounted plug.

In view of the relatively small dimensions of the bearing surface 32 of the rear section 31 of the barrel, and the bearing surface 80 of the journal member 79, measured in the longitudinal direction, these surfaces and the inner surface of the stop lug 42 may be provided with the same taper as the barrel bore 15 or may be cylindrically formed, as desired. The opposite side surfaces of the journal member 79 lie in planes perpendicular to the longitudinal axis of the plug 45.

While a preferred embodiment of the invention has been described and illustrated, and reference has been made to certain changes and modifications which may be made therein, it will be apparent to those skilled in the art that further changes and modifications may be made therein within the spirit and scope of the invention. It is intended that all such changes and modifications be included within the scope of the appended claims.

I claim:

1. In a plate tumbler-type cylinder lock mechanism including an elongate barrel having a longitudinal bore therein, and a key plug having a body portion and a shaft portion extending therefrom, said plug being received rotatably in said bore with said body portion extending between opposite ends of the barrel and said shaft portion extending outwardly from one end of the barrel, said bore having a draft-induced longitudinal taper widening in the direction of said one end of the barrel, the improvement which comprises journal means on said body portion and projecting laterally therefrom for journalling said plug in said barrel adjacent to said one end thereof, thereby to minimize lateral play between the plug and the barrel thereat.

2. A lock mechanism as defined in claim 1 and including stop means for interengaging said journal means and said barrel, thereby to limit the rotation of said plug.

3. A lock mechanism as defined in claim 2 and wherein said journal means is integral with said plug, and said stop means comprises lug means integral with said barrel internally thereof and adapted to engage said journal means.

4. A lock mechanism as defined in claim 3 and wherein said plug and said journal means together comprise a one-piece casting, and said barrel and said lug means together comprise a one-piece casting.

5. A lock mechanism as defined in claim 1, 2, 3 or 4 and including a transverse shoulder on the wall of said bore adjacent to the end of said barrel opposite to said one end, and wherein said taper extends from adjacent to said shoulder to adjacent to said one end.

6. A lock mechanism as defined in claim 1, 2, 3, or 4 and wherein a part of said body portion extends outwardly from the end of said barrel opposite to said one end, and including means on said extending part of the body portion for mounting a retainer thereon to engage said opposite end of the barrel for securing said plug in the barrel.

7. A lock mechanism as defined in claim 1, 2, 3 or 4 and wherein said body portion is substantially cylindrically shaped, and said journal means comprises a ring-shaped member projecting laterally from said body portion.

8. In a plate tumbler-type cylinder lock mechanism including an elongate barrel having a longitudinal bore therein, and a key plug having a body portion and a shaft portion extending therefrom, said plug being received rotatably in said bore with said body portion extending between opposite ends of the barrel and said shaft portion extending outwardly from one end of the barrel, said bore having a draft-induced longitudinal taper widening in the direction of said one end of the barrel and said body portion being substantially cylindrically shaped, the improvement which comprises ring-shaped flange means on said body portion and projecting laterally therefrom for journalling said plug in said barrel adjacent to said one end thereof, said flange means defining a recess between portions thereof, and stop means comprising lug means on said barrel internally thereof and adapted to extend into said recess for interengaging said flange means and said barrel, thereby to limit rotation of said plug.

9. A lock mechanism as defined in claim 8 and wherein said plug and said flange means together comprise a one-piece casting, and said barrel and said lug means together comprise a one-piece casting.

10. A lock mechanism as defined in claim 8 or 9 and including a transverse shoulder on the wall of said bore adjacent to the end of said barrel opposite to said one end, and wherein said taper extends from adjacent to said shoulder to adjacent to said one end.

11. A lock mechanism as defined in claim 10 and wherein a part of said body portion extends outwardly from the end of said barrel opposite to said one end, and including means on said extending part of the body portion for mounting a retainer thereon to engage said opposite end of the barrel for securing said plug in the barrel.

12. A lock mechanism as defined in claim 11 and including a split ring comprising said retainer, said mounting means comprising means forming an annular groove in said body portion part receiving said split ring therein.

* * * * *